US005249838A

United States Patent [19]

Kulpa et al.

[11] Patent Number: 5,249,838

[45] Date of Patent: Oct. 5, 1993

[54] SEATING DEVICE HAVING CURVED BOTTOM TILTING ON ROLLER AND SECURED BY REEVED CABLE

[76] Inventors: Judith I. Kulpa, 2938 N. 61th St., Milwaukee, Wis. 53210; Michael F. Conmy, 19480 Timberline Dr., Waukesha, Wis. 53186; Todd Fillingham, 2014 E. Webster Pl., Milwaukee, Wis. 53211; Mary K. Sydow, 810 N. Washington St., New Ulm, Minn. 56073

[21] Appl. No.: 586,625

[22] Filed: Sep. 21, 1990

[51] Int. Cl.[5] ..... A47C 1/02; A47C 1/06; A47C 1/12; A61G 7/00

[52] U.S. Cl. ..... 297/328; 297/302; 297/DIG. 4; 248/371

[58] Field of Search ..... 297/318, 325–328, 297/311, 261, 263–269, 301, 302, 337, 340–344; 5/62, 81 R, 81 B; 248/393–398, 429, 430, 371, 372.1, 564

[56] References Cited

U.S. PATENT DOCUMENTS

| | | | |
|---|---|---|---|
| 735,185 | 8/1903 | White | 297/266 |
| 2,313,023 | 3/1943 | Ruegger | 297/344 |
| 2,986,200 | 5/1961 | Nobile | 297/327 |
| 4,383,714 | 5/1983 | Ishida | 297/327 X |
| 4,441,758 | 4/1984 | Fleischer et al. | 248/371 X |
| 4,706,920 | 11/1987 | Ojima et al. | 248/371 |
| 4,790,599 | 12/1988 | Goldman | 297/327 |
| 4,847,929 | 7/1989 | Pupovic | 5/62 |
| 4,941,709 | 7/1990 | Moller | 297/325 |
| 4,957,302 | 9/1990 | Maxwell | 297/261 X |

FOREIGN PATENT DOCUMENTS

| | | | |
|---|---|---|---|
| 2307672 | 4/1975 | France | 297/325 |
| 585196 | 1/1947 | United Kingdom | 248/393 |

OTHER PUBLICATIONS

Metropolitan Home, Sep. 1989, p. 99.

*Primary Examiner*—Peter R. Brown
*Assistant Examiner*—James M. Gardner
*Attorney, Agent, or Firm*—Ryan, Kees & Hohenfeld

[57] ABSTRACT

A narrow seating device or chair including a support caddy having lockable ground engaging caster wheels and a seat portion for a patient undergoing a medical test. The seat portion is detachably mounted on the support caddy and tiltable to a plurality of tilt positions. The seat portion has a convexly curved surface which rests on spaced apart rollers on the upper side of the support caddy to enable tilting. A safety mechanism detachably secures the seat portion to the support caddy, while still allowing for tilting. The safety mechanism includes a flexible steel cable which is reeved around a pulley attached to the curved surface. The ends of the cable are secured to the support caddy. A tension spring and a turnbuckle to adjust spring tension are connected each to a respective one of the ends of the cable. A locking mechanism releasably locks the seat portion in a selected tilt position. The locking mechanism includes a manually operable, axially movable, spring biased locking pin mounted on the support caddy. The locking pin engages one of a plurality of pin holes in a rim plate affixed to a side of the seat portion. Accessories for the chair are provided and include detachable adjustable arm rests, straps for safely securing the patient, an adjustable pillow, and attachment points for IV standards, oxygen tanks and other attachments.

8 Claims, 2 Drawing Sheets

10a
5
17
16
14
10
18
5
73a
70
73
71
71a
24
22
76
P
74
52
53
54
51
12
20

24
22
33
62
34
32
22
72
10b
P
21
14
18
20

SEATING DEVICE HAVING CURVED BOTTOM TILTING ON ROLLER AND SECURED BY REEVED CABLE

BACKGROUND OF THE INVENTION

This invention relates generally to an adaptive seating device (hereinafter called "chair") such as for a patient undergoing a modified barium swallowing fluoroscopic imaging study, and in particular to the construction of the chair which is used to properly position the patient during the study to optimize the study results.

In the fields of medicine and speech pathology it is sometimes necessary to evaluate and treat persons with dysphagia, a swallowing disorder which interferes with speech and/or ingestion of food and liquids. Patients can include the neurologically impaired (CVA, ALS, cerebral palsy, myasthenia gravis), orthopedically impaired (Kyphosis, arthritis), cognitively impaired (closed head injury, dementia), and head and neck cancer patients. Typically, the action of the patient's oral cavity, pharynx and esophagus is observed by means of a fluoroscope while the patient swallows a liquid, paste or masticated material, containing barium.

To optimize the result of the study, it is necessary to place the patient in proper position while the radiologic procedure is carried out. In a modified barium swallow study (as contrasted with a simple barium swallow study) the patient must be upright during the study, that is, in a normal physiological position naturally assumed during normal eating and drinking. Patients with the above disorders exhibit concomitant movement alterations, thereby necessitating seating and positioning adaptations during the study to assure that the patient is placed in a proper position and can remain comfortably and safely in that position. Prior art imaging tables and radiologic equipment do not always accommodate the special positioning needs of some patients.

Therefore, it is desirable to provide an improved adaptive seating device or chair in accordance with the present invention.

SUMMARY OF THE INVENTION

A chair in accordance with the present invention generally comprises a support caddy having lockable casters enabling it to be moved across a floor. A seat is further included for accommodating a patient, which seat is detachably mounted and tiltably positionable to desired positions on the support caddy. The seat is then releasably locked in that position. The seat has a frame with an ergonomically-shaped profile to conveniently and safely seat the patient, and is provided with a removable cushion, detachable arm rests, various safety belts and an adjustable pillow. The seat is supported on the caddy support by means of rotatable members, such as rollers, which are rotatably mounted on the support caddy and engage the underside of a convexly curved portion or member affixed to the underside of the seat. These rollers enable the seat to be tiltably moved fore and aft or positioned to a plurality of tilt positions relative to the support caddy. Safety means are provided to releasably secure the seat to the support caddy and comprise a flexible metal cable which has its ends secured to the support caddy through a helical tension spring and a turn-buckle. The cable is reeved around a pulley which is mounted on the underside of the seat. Releasable locking means are provided to lock the seat in a desired tilt position to which it has been moved.

The locking means comprise a manually operable spring biased latch pin mounted on a side of the support caddy which is releasably engageable with any one of a plurality of pin receiving holes in a member affixed to a side of the seat.

A chair in accordance with the present invention provides several important advantages over the prior art. It is relatively narrow and is able to fit, with the patient, between a fluoroscopy table and an imaging tube, to facilitate both lateral and A/P views. It is fabricated of radiolucent materials where appropriate. Its ergonomic shape enables it to accommodate contracted or mobility-impaired patients. The tilting function of the seat enables proper positioning of the patient relative to both the normal upright position of a patient and to the radiologic equipment. Its design facilitates placement in and removal of the patient at bedside and enables convenient and safe transport of the patient to the radiologic facility. It is safe to use for both patient and clinical staff. It is easy to clean and is easy to assemble and disassemble for cleaning, maintenance or storage. It is relatively economical to manufacture.

Other objects and advantages of the invention will become apparent hereinafter.

DESCRIPTION OF THE PREFERRED EMBODIMENT

Figures 1, 5:
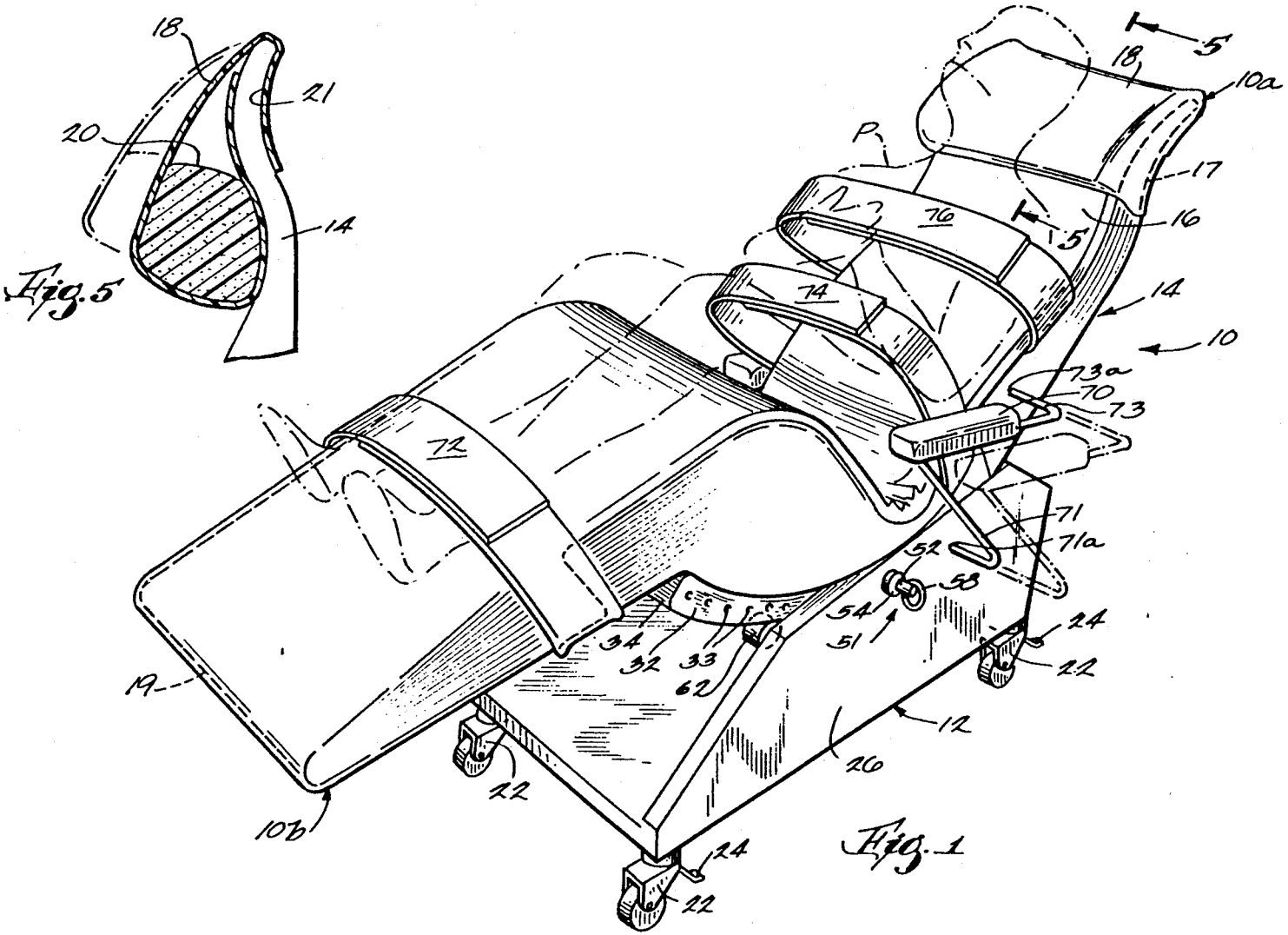
FIG. 1 is a perspective view of a chair in accordance with the invention taken from the left front side thereof.
FIG. 5 is an enlarged cross-sectional view of a portion of the chair taken generally along line 5—5 of FIG. 1 and shows the pillow pouch.
Figures 2, 3, 4:
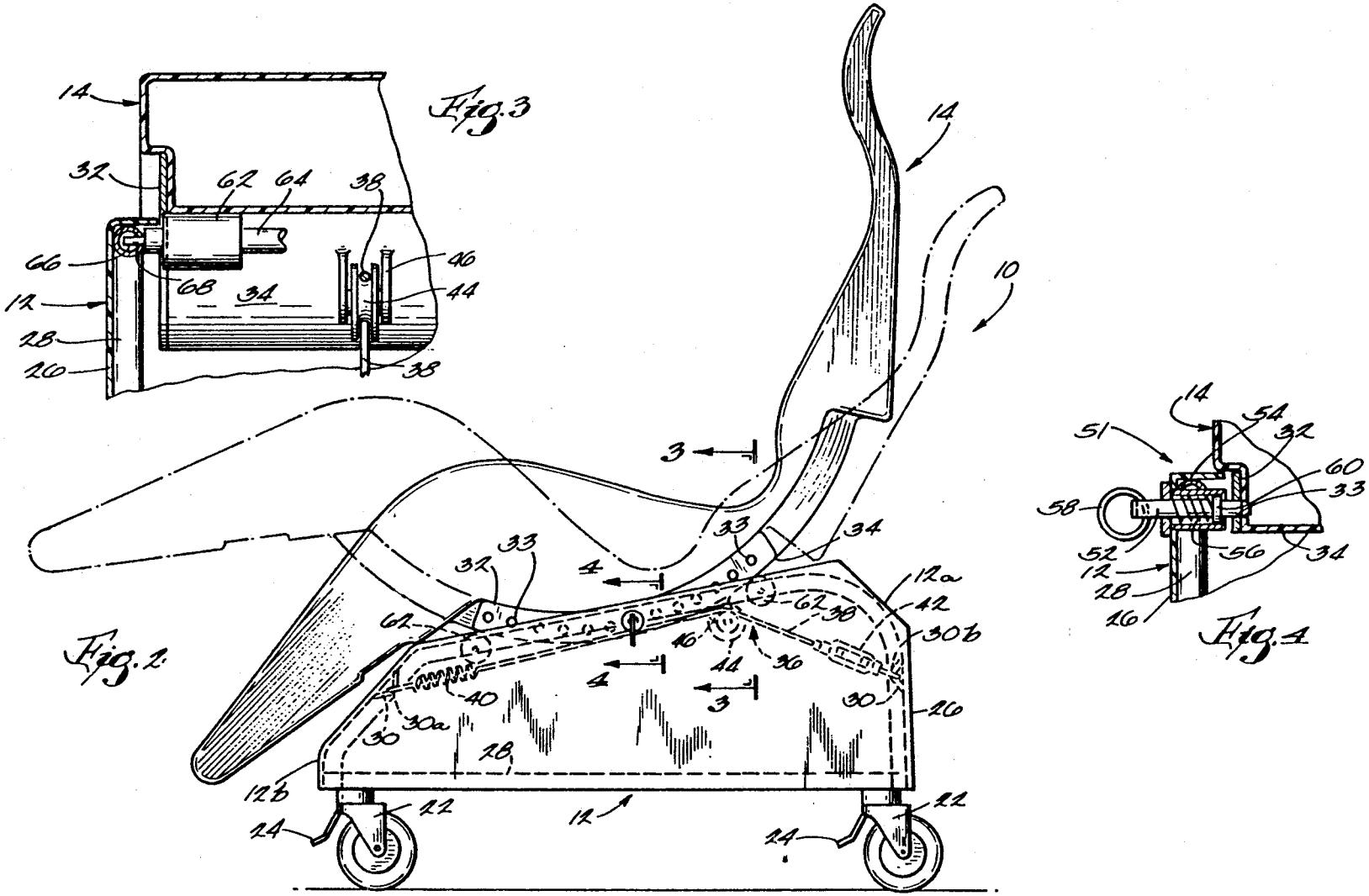
FIG. 2 is a left side elevational view of the chair with the arms removed and showing the seat in an alternate tilt position in phantom lines.
FIG. 3 is an enlarged cross-sectional view of a portion of the chair taken generally along line 3—3 of FIG. 2 and shows a pulley and a roller.
FIG. 4 is an enlarged cross-sectional view of a portion of the chair taken generally along line 4—4 of FIG. 2 and shows the locking means.

Referring to FIGS. 1 and 2, there is shown a chair 10 in accordance with the invention having a head end 10*a* and a foot end 10*b*, and which comprises a support caddy 12 and a seat portion 14.

The support caddy 12 comprises a tubular caddy frame 28, including two cross bars 30, on which a caddy housing 26 is rigidly mounted. The frame 28 and cross bars 30 are preferably made of metal, such as aluminum, while the housing 26 is preferably formed of plastic, such as polyethylene. The support caddy 12 is provided with four casters 22, each of which has a wheel which can rotate and swivel, and each is provided with a foot operated caster locking lever 24 to lock the caster 22 against rolling and swiveling. The seat portion 14, which can be molded of polyethylene plastic, is provided with a seat cushion 16 which is preferably vinyl covered for easy cleaning and disinfecting. The seat cushion 16 is secured to the seat portion 14 by a head end sleeve 17 and a foot end sleeve 19 which slip over the ends of the seat portion 14. The seat portion 14 has an ergonomic shape which, when tilted in upright position, generally places a patient P in a normal seated position. The seat portion 14 has an arcuately curved underside 34. The left side edge of curved underside 34 has a correspondingly curved metal rim plate 32 rigidly secured thereto, as FIGS. 1 through 4 show.

The seat portion 14 is supported on support caddy 12 by means of a plurality of rollers 62, four in the embodiment shown. In this embodiment two roller shafts 64 are provided, one near the head end 12*a* of the support caddy 12 and the other near the foot end 12*b* of the support caddy. As best shown in FIG. 3, each roller 62 is mounted on one end of a roller shaft 64 which has a shaft axle end 66 journaled for rotation in a shaft axle hole 68 in caddy frame 28. The rollers 62 engage the curved underside 34 of seat portion 14. The curved underside 34 extends slightly into a recess in the upper side of support caddy 12 and, as FIG. 3 shows, cannot shift laterally. The rollers 62 enable the seat portion 14 to be tiltably moved fore and aft to any one of a plurality of desired tilt positions, as FIG. 2 makes clear.

Referring to FIGS. 2 and 3, a safety mechanism 36 is provided to secure the seat portion 14 to support caddy 12, while still enabling seat portion 14 to be tilted to desired positions. The safety mechanism 36 comprises a cable 38, a spring 40 connected to one end of cable 38, and a turnbuckle 42 connected to the other end of cable 38. The spring 40 has a hook 41 which engages a hole 30*a* in the foot end cross bar 30 and the turnbuckle 42 has a hook 43 which engages a hole 30*b* in the head end cross bar 30. The cable 38 is reeved over a pulley 44 which is rotatably mounted on a pulley support 46, in turn secured to the curved underside 34 of seat portion 14 (see FIGS. 2 and 3). The safety mechanism 36 biases the seat portion 14 against the support caddy 12.

As FIGS. 1 through 4 show, the left side of curved underside 34 of seat portion 14 is provided with a rim plate 32 rigidly secured thereto as by screws (not shown). The rim plate 32, preferably of metal such as aluminum, is provided with a plurality of pin holes 33.

Referring to FIGS. 2 and 4, a locking mechanism 51 is provided to releasably lock seat portion 14 in a selected tilt position and also operates to help secure seat portion 14 to support caddy 12. The locking mechanism 51 comprises a locking pin 52 mounted for axial sliding movement in a locking pin housing 54, which housing is, in the embodiment shown, mounted on the left side of support caddy 12. The locking pin 52 is biased inwardly into engagement with a selected one of the pin holes 33 by means of a helical compression type locking pin spring 56 in locking pin housing 54 which engages a pin stop 60 on locking pin 52 (see FIG. 4). The locking pin 52 has a pin ring 58 which facilitates locking pin 52 being manually pulled outwardly (that is, to the left in FIG. 4) when seat portion 14 is to be tilted or when chair 10 is being assembled or disassembled.

The chair 10 is provided with several optionally usable accessories including two detachable arm rests 70 (one shown in FIG. 1), a detachable pillow pouch 18, a leg strap 72, a waist strap 74, a torso strap 76 and a head strap (not shown), and various brackets and mounting holes (not shown) on the sides of support caddy 12 to which equipment (not shown) such as IV standards, oxygen bottles and the like, can be securely mounted.

The arm rest 70 shown includes support rods 71 and 73 which are slidably insertable laterally in holes 71*a* and 73*a*, respectively, in the left sides of support caddy 12 and seat portion 14, respectively. The rods 71 and 73 are long enough to allow the arm rest 70 to be positioned inwardly or outwardly to accommodate patients of different sizes.

The leg strap 72, waist strap 74 and torso strap 76 can be made of any strong flexible material, such as vinyl, and have any desirable shape and are understood to be provided with hook-and-pile type fasteners (not shown) on the straps and on the seat portion 14 to enable attachment.

The pillow pouch 18 comprises a pillow sleeve 21 which slips over the head end of the seat cushion 16 (see FIG. 5) and is adapted to receive a pillow 20. The pillow 20 can be slipped into the sleeve 21 and may be of various sizes so as to properly position a patient's head on the chair 10.

OPERATION

The chair 10 is initially assembled by placing seat portion 14 upside down on a suitable surface and then placing support caddy 12, also upside down, on seat portion 14 while holding locking pin 52 in its release position until a proper fit is accomplished. Thereafter, safety mechanism 36 is attached by reeving cable 38 around pulley 44 and hooking spring 40 and turnbuckle 42 to their respective cross bars 30. The turnbuckle 42 is adjusted to allow for a minimum of about one inch compression of spring 40. The chair 10 is then placed upright, the seat cushion 16 is placed on seat portion 14, and the pillow pouch 18 and pillow 20 are installed on the seat cushion 16. Disassembly of the chair 10 is accomplished by reversing the foregoing assembly procedure. The chair 10, when so assembled, is ready to receive a patient.

The seat portion 14 can be tilted to and locked in a normal seating position to receive an ambulatory patient or can be moved alongside and parallel to a bed (not shown) and tilted to a reclined position to receive a recumbent patient who is transferred from bed to chair 10 in accordance with conventional hospital practice. In either case, the casters 22 are locked to immobilize chair 10 as the patient occupies or is transferred to chair 10. The leg strap 72, waist strap 74 and torso strap 76 are then emplaced, as required, to safely secure the patient in chair 10, and arm rest 70 may be emplaced. Various optional equipment required by the patient, such as IV standards, oxygen bottles and the like, may be attached to chair 10. When the patient is ready, the casters 22 are unlocked and the chair 10 is rolled to the site of the radiological equipment (not shown) and chair 10 is properly positioned in the narrow space between components of the fluoroscopic equipment. The arm rest 70 may be adjusted or removed, as required. The tilt of seat portion 14 is adjusted, as required, by releasing and then re-locking the locking mechanism 51, and the casters 22 are locked. After the fluoroscopic examination is completed, the chair 10 is withdrawn from the narrow space and the chair, with patient therein, is transported to the appropriate place whereat the patient is assisted in leaving chair 10.

An actual embodiment of the chair 10 was on the order of 15½" wide, 50" high, 52" long and weighed 110 pounds. The chair 10 tapered to 13" at the uppermost head end of the seat portion 14 to facilitate fitting between closely placed components of the radiological equipment.

While the apparatus hereinbefore described is effectively adapted to fulfill the aforesaid objects, it is to be understood that the invention is not intended to be limited to the specific preferred embodiment of adaptive seating device set forth above. Rather, it is to be taken as including all reasonable equivalents within the scope of the following claims.

We claim:

1. An adaptive seating device comprising:

support means;

a seat portion for accommodating a person and detachably mounted on and tiltably positionable on said support means, said seat portion having a curved surface on its underside;

rotatable means mounted on said support means and engaged with said curved surface on said seat portion to support said seat portion and to enable said seat portion to be tiltably moved to any one of a plurality of tilt positions relative to said support means;

means for biasing said curved surface into engagement with said rotatable means so as to secure said seat portion to said support means; and locking means to releasably maintain said seat portion in a selected tilt position;

wherein said biasing means comprises a pulley rotatably mounted on said seat portion, a flexible cable reeved around said pulley, first means for connecting one end of said cable to said support means, and second means, including spring means, for connecting the other end of said cable to said support means.

2. A device according to claim 1 wherein said rotatable means comprises spaced apart roller means, each roller means having an axis of rotation spaced apart from and parallel to the axis of rotation of the other roller means.

3. A device according to claim 1 wherein said releasable locking means comprises a first member on said support means releasably engageable with a second member on said seat portion.

4. A device according to claim 3 wherein said support means is provided with ground engaging wheels.

5. A device according to claim 4 including detachable arm rest means for said seat portion.

6. An adaptive seating device for a patient undergoing a modified barium swallow study comprising:

a. a support caddy having releasably lockable ground engaging caster wheels and spaced apart rollers near the upper side thereof;

b. a seat portion which is detachably mounted on said support caddy and tiltable to any one of a plurality of tilt positions relative to said support caddy, said seat portion having a convex downwardly facing curved surface at its underside which rests on said spaced apart rollers to enable tilting of said seat portion;

c. a safety mechanism detachably securing said seat portion to said support caddy while still allowing for tilting of said seat portion, including:

i. a flexible cable, ii. a pulley attached to said curved surface and around which said cable is reeved, iii. a tension spring connected to one end of said cable and to said support caddy, iv. a turnbuckle connected to the other end of said cable and to said support caddy; and d. a locking mechanism for releasably locking said seat portion in a selected tilt position, including a manually operable, axially movable, spring biased locking pin mounted on said support caddy which engages one of a plurality of pin holes in a rim plate affixed to a side of said seat portion.

7. A device according to claim 6 further including at least one arm rest detachably mounted on a side of said device.

8. A device according to claim 6 or 8 further including a pillow detachably mounted near the head end of said seat portion.

* * * * *

UNITED STATES PATENT AND TRADEMARK OFFICE

CERTIFICATE OF CORRECTION

PATENT NO. : 5,249,838

DATED : October 5, 1993

INVENTOR(S) : Judith I. Kulpa et al.

It is certified that error appears in the above-indentified patent and that said Letters Patent is hereby corrected as shown below:

Column 6, Claim 8, Line 36:

After "claim 6 or" delete "8" and substitute therefor --- 7 ---

Signed and Sealed this

Fourth Day of October, 1994

*Attest:*

*Attesting Officer*

BRUCE LEHMAN

*Commissioner of Patents and Trademarks*